US010435822B2

(12) United States Patent
Buffington et al.

(10) Patent No.: US 10,435,822 B2
(45) Date of Patent: Oct. 8, 2019

(54) RESILIENT YARN AND FABRIC HAVING THE SAME

(71) Applicant: Glen Raven, Inc., Glen Raven, NC (US)

(72) Inventors: David J. Buffington, Elon, NC (US); Kenneth P. Wallace, Greensboro, NC (US); Robert J. Mauritz, Pawtucket, RI (US); Nicholas M. Luther, Greenville, SC (US)

(73) Assignee: Glen Raven, Inc., Glen Raven, NC (US)

( * ) Notice: Subject to any disclaimer, the term of this patent is extended or adjusted under 35 U.S.C. 154(b) by 63 days.

(21) Appl. No.: 15/442,062

(22) Filed: Feb. 24, 2017

(65) Prior Publication Data

US 2018/0245248 A1 Aug. 30, 2018

(51) Int. Cl.
*A47C 7/28* (2006.01)
*D02G 3/32* (2006.01)

(52) U.S. Cl.
CPC ..... *D02G 3/32* (2013.01); *A47C 7/282* (2013.01)

(58) Field of Classification Search
None
See application file for complete search history.

(56) References Cited

U.S. PATENT DOCUMENTS 2,539,300 A 1/1951 Foster
3,382,662 A 5/1968 Seelig et al.
3,739,567 A 6/1973 Williamson
4,587,997 A 5/1986 Brooks
4,663,221 A 5/1987 Makimura et al.
5,601,775 A 2/1997 Cunningham et al.
5,635,298 A * 6/1997 Delker ..... D01F 8/14 428/373
5,762,403 A 6/1998 Robinson
5,770,307 A 6/1998 Rackley et al.
5,972,463 A 10/1999 Martin et al.
5,985,961 A * 11/1999 Dailey ..... C08K 3/04 428/480
6,908,869 B2 6/2005 Haun et al.
7,134,266 B2 11/2006 Bourbon et al.
7,763,555 B2 7/2010 Nguyen et al.
8,484,940 B2 7/2013 Bruner
9,234,304 B2 1/2016 Bruner
(Continued)

FOREIGN PATENT DOCUMENTS

WO 0166851 9/2001

OTHER PUBLICATIONS

Fabric sample from The Quantum Group, Inc., believed to be comprised of Hyrtrel® biocomponent warp yarn in a leno weave structure, with a non-Hytrel® fill yarn; known at least as early as Feb. 23, 2017, 1 pg.

(Continued)

*Primary Examiner* — Shawn Mckinnon
(74) *Attorney, Agent, or Firm* — Womble Bond Dickinson (US) LLP

(57) ABSTRACT

A resilient yarn, fabric having the resilient yarn, and outdoor products, such as sling furniture, are disclosed. The resilient yarn includes a core made with a thermoplastic elastomer. A sheath at least partially surrounds the core. The sheath includes polyvinyl chloride (PVC) or a blend of PVC and thermoplastic polyurethane (TPU).

18 Claims, 15 Drawing Sheets

(56) References Cited

U.S. PATENT DOCUMENTS

| | | | | |
|---|---|---|---|---|
| 9,303,342 | B2 | 4/2016 | Wang et al. | |
| 9,435,059 | B2 | 9/2016 | Smith et al. | |
| 2004/0028873 | A1 | 2/2004 | Corbett et al. | |
| 2005/0042412 | A1* | 2/2005 | Bruner | D02G 3/32 428/92 |
| 2007/0014988 | A1 | 1/2007 | Tseng | |
| 2007/0087158 | A1 | 4/2007 | Bruner | |
| 2013/0298520 | A1 | 11/2013 | Bruner | |
| 2015/0044448 | A1 | 2/2015 | Smith | |
| 2015/0111451 | A1 | 4/2015 | Date et al. | |
| 2016/0167597 | A1 | 6/2016 | Jeunesse et al. | |

OTHER PUBLICATIONS

DuPont Hytrel Thermoplastic Polyester Elastomer product information and design guide, known at least as early as Jan. 30, 2015, 86 pgs.

International Search Report for PCT/US2018/018875, dated Apr. 23, 2018, 9 pgs.

The Science and Engineering of Materials, Third Edition, Donald R. Askeland, pp. 498, 505 and 510, dated 1994, 3 pgs.

* cited by examiner

RESILIENT YARN AND FABRIC HAVING THE SAME

FIELD OF INVENTION

The present disclosure is directed to elastomeric yarns suitable for use in outdoor environments. The present disclosure is also directed to fabrics suitable for outdoor use that include suitable elastomeric yarns. In some instances the fabrics are furniture fabrics.

BACKGROUND

Outdoor furniture presents many challenges and opportunities to furniture and textile designers. Designers are seeking to make outdoor furniture resemble indoor furniture to a larger degree. The latest outdoor furniture seeks to mimic not only the appearance, but also the comfort, hand, and function of indoor furniture. Designing fabric with these qualities that is suitable for use on outdoor furniture is often difficult. Unlike indoor fabrics, a fabric that is "suitable for outdoor use" is subject to much harsher conditions over an extended period of time. Moisture, UV radiation from the sun, and fluctuating temperatures, which range from the heat of summer to the cold of winter, all heavily degrade the materials most commonly found in indoor fabrics, such as polyester. This degradation traditionally can be defined by physical property changes, such as tenacity reduction and/or elongation reduction of a yarn or fabric. A change in color or surface gloss of the material is also an indicator of degradation.

There are several accelerated test methods that can be used to measure a yarn or fabric's suitability to be used outdoors. A weatherometer using xenon arc lamps, or a QUV accelerated weathering tester using UV florescent lamps, are examples of machines capable of these accelerated methods. Test methods, such as SAE J2527 (version February 2004), combine the use of water spray with cycles of light and dark exposure to a prescribed xenon light source within the testing device. The xenon source is controlled at 0.55 $Wm^2$ at 340 nm irradiance. However, the total spectral band ranges from 290-800 nm. A sample is "suitable for outdoor use" based on color and gloss loss if, after total exposure of at least 1500 KJs in method SAE J2527, the sample maintains at least a grade 3 on the Grey Scale colorfastness test. As is known in the art, Grey Scale is a well-recognized visual test of colorfastness providing grades from 1 to 5, where grade 5 represents minimal or no change and grade 1 represents severe change in color. This evaluation can be completed by a trained technician or an instrument such as a spectrophotometer.

One style of outdoor furniture ripe for improvement is sling furniture. Generally recognized in the art, sling furniture is characterized by a fabric panel or "sling" supported and held in a taut manner upon a frame. An example of a sling chair 10 is shown in FIG. 1. The sling chair 10 has a frame 12 and one or more sling panels 14. The sling panel 14 may be held along two or more edges, depending upon the design of the frame 12. Sling type construction is gaining popularity on indoor furniture, such as office chairs. The fabric used on these indoor office chairs provides significant comfort by using fabric that is able to stretch and recover. Common materials in these fabrics include bare co-polyester thermoplastic elastomers, such as Hytrel® from Dupont™. However, use of bare co-polyester thermoplastic elastomers means that these fabrics would be expected to degrade and/or fade rapidly, and therefore are generally known as unsuitable for outdoor use. Carbon black pigment can be added to the thermoplastic elastomer in order to support performance when used outdoors, but the color offering for decorative products becomes severely limited if only black is available. FIGS. 2*a* and 2*b* show the effects on elongation loss percentage and break strength of a bare Hytrel® yarn that includes black pigment and a UV package. This sample was subject to UV in accordance with AATCC 169 (2003). After exposure of 1320 KJs, the bare sample had lost more than half of its ability to elongate. UV exposure resulted in a reduction of more than 30% in break strength as well. Like SAE J2527, the AATCC 169 method can be used to evaluate a product's potential for outdoor use. This method specifies conditions at 77° C. with a continuous light source ranging from 290-800 nm. This method has been found to be detrimental to many polymers.

Known outdoor sling fabrics incorporate high tenacity high modulus polyester yarns that are coated with PVC. Use of these PVC coated polyester yarns generally have the necessary stability and durability for use on outdoor furniture. Known outdoor sling fabrics, however, may provide less comfort compared to recent indoor sling fabrics, because the outdoor fabrics are less capable of stretch and recovery. Therefore, there is a need for fabrics that are suitable for use in outdoor sling furniture that provide the stretch and recovery characteristics known to support a comfortable sit for the user.

SUMMARY

Embodiments of the present disclosure include a resilient yarn. The resilient yarn includes a core comprising a thermoplastic elastomer and a sheath at least partially surrounding the core. The sheath comprises polyvinyl chloride (PVC), or a blend of PVC and thermoplastic polyurethane (TPU).

Other embodiments of the present disclosure include a method of forming a resilient yarn. The method includes acquiring a monofilament comprising a thermoplastic elastomer. The method also includes melting a sheath compound in an extrusion screw and feeding the molten sheath compound to a crosshead die. The method also includes feeding the monofilament to the crosshead die and coating the monofilament with a layer of the molten sheath compound. The sheath compound comprises an abrasion resistant polymer and a stretchable polymer.

Yet other embodiments include a fabric. The fabric has resilient yarns comprising a core having at least a thermoplastic elastomer, and a sheath comprising polyvinyl chloride, or a blend of PVC and thermoplastic polyurethane. The fabric may also include additional other yarns. Sling furniture made using the fabric is also described.

Still additional embodiments include a method of making a fabric. The method includes weaving a fabric. The fabric is woven with resilient yarns in a fill direction. The resilient yarns comprise a core with thermoplastic elastomer and a sheath comprising polyvinyl chloride or a blend of PVC and thermoplastic polyurethane. The fabric is also woven with other yarns in a warp direction. At least some of the other yarns comprise strength yarns. The method also includes heat setting the fabric to tack the sheath of the resilient yarns to at least some of the other yarns.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 3:
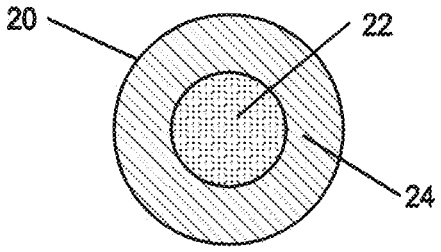
FIG. 3 is a schematic cross sectional view of a resilient yarn according to an embodiment of the present disclosure.

To create a fabric suitable for outdoor sling furniture that has improved stretch and recovery, the inventors have developed a resilient yarn that is more robust under outdoor conditions compared to prior elastomeric yarns, and more elastic compared to prior outdoor suitable yarns. As seen in FIG. 3, the resilient yarn 20 comprises a core 22 formed from elastic material, such as a thermoplastic elastomer (TPE). One suitable TPE may be a thermoplastic co-polyester elastomer. One such co-polyester elastomer is sold by DuPont™ under the trade name Hytrel®. To form the core 22, a TPE resin may be extruded or otherwise manufactured to form a monofilament intermediary yarn with a denier of between about 1200 and about 2500. Use of a multi-filament core is also possible. The selection of a TPE for use in forming the core 22 should provide the resilient yarn 20 with suitable stretch and recovery properties. The core 22 should be capable of achieving 10% elongation under a load of less than four lbf. Preferably the core 22 should be capable of achieving 10% elongation under a load of less than 2.5 lbf. The TPE of the core 22 may have a durometer of between about 50 and about 75 in the shore D scale.

The material forming the core 22 may also include optional additives such as UV stabilizers, color pigments, heat stabilizers, lubricants, antifungal agents, antimicrobial agents and flame retardants. In one example, a lubricant package is expected within the TPE to assist spooling during the manufacturing process of the core 22. Proper lubrication helps ensure that the core 22 will unwind in an even manner from the spool when forming the resilient yarns 20. Often, heat stabilizers are also used as processing additives to prevent degradation during processing. UV stabilizers and pigments may be added to the TPE, especially in the cases where the core 22 will remain uncoated or will be coated with a clear layer. Other performance additives, such as antimicrobial and antifungal compounds, are commonly used in outdoor applications for their known functions.

As shown in FIG. 3, the resilient yarn 20 further comprises a sheath 24 at least partially surrounding the core 22. Applying the sheath 24 to the core 22 renders the resilient yarn 20 suitable for outdoor use by increasing UV resistance. The sheath 24 is configured to protect the core 22 from the detrimental effects of outdoor weathering. The material or blend of materials of the sheath 24 are selected such that the stretch and recovery properties of the core 22 are substantially maintained and the sheath is able to remain attached to the core after use cycle testing. In an embodiment, the inventors have determined that the core 22 may provide a majority of the strength component of the resilient yarns 20. Therefore, the core 22 is expected to have a higher elastic modulus than the sheath 24. The sheath materials are selected such that the sheath 24 provides the ability for a fabric to be finished (e.g. heated) in a way that allows the resilient yarns 20 to be thermally bonded to themselves and/or other yarns, thus improving the stability of a resulting fabric having the resilient yarns.

The sheath 24 may comprise polyvinyl chloride (PVC) or a blend of PVC and thermoplastic polyurethane (TPU). In one embodiment, a blend of resin may comprise at least about 30% PVC, preferably at least about 45% PVC and more preferably about 52% PVC with the remainder of the resin blend substantially comprising TPU. As such, the blend of resin may be considered as having approximately equal parts PVC and TPU.

The material forming the sheath 24 may also include additives such as UV stabilizers, color pigments, heat stabilizers, lubricants, antifungal agents, antimicrobial agents and flame retardants. These additives help insure the core 22 is well protected from outdoor weathering and property loss. In one example, various UV packages may be used, such as UV absorbers and hindered amine light stabilizers. The UV package helps to protect the various polymers from degradation, and extends the useable life expectancy of the resilient yarn 20. In several embodiments, a pigmentation package will be used to add various colors to the sheath 24 for aesthetic value. These pigments must have good weather fastness and resistance to normal cleaners. Outdoor materials are exposed to many environmental pollutants, mold, fungus, and general dirt. Outdoor materials may experience frequent cleaning cycles. Therefore, the materials selected for the sheath 24 should be substantially resistant to a range to common chemicals that are used for cleaning outdoor fabrics. The most common mix is a solution made with 10% or less bleach with 2% or less mild detergent. Without the sheath 24 the material of the core may degrade significantly if cleaned with bleach.

Other additives found in the sheath 24 may include a lubricant package. Use of lubricants in the compound contributes to the manufacturability of the coating process and the ability to wind useable packages of resilient yarn 20 at the end of the extrusion yarn coating process. As an example, lubricant allows for the compound material to avoid improperly adhering to dies, screws, and touch points in the extrusion coating process. During processing, antioxidant and heat stabilizer are formulated to improve the heat stability of the sheath material during processing, and resist oxidation.

In one example, the addition of flame retardants may be important for use of the resilient yarns 20 in cruise ship furniture, because the cruise ship industry is governed by strict International Maritime Organization (IMO) regulations.

In some alternative embodiments, the sheath 24 could be formed from base polymers other than PVC and TPU. In some embodiments, the sheath 24 comprises at least one of polyester, polyethylene, and polypropylene polycarbonate for abrasion resistance and finishing characteristics in combination with at least one of synthetic rubber and natural rubber to provide stretch.

The sheath 24 may be applied to the core 22 as an extrusion coating. The coating may be a layer have a thickness of about 0.005", but could also range from 0.0025 to 0.05. As a coating, the sheath is applied to the core 22 after the core has been acquired as a monofilament intermediary yarn. For example, the core 22 may be pulled over the edge of a double flanged spool through the extrusion coating process. A typical extrusion coating machine would include a hopper for the introduction of sheath compound into the extrusion process. The sheath compound would then be feed into an extrusion screw with distinct zones designed to melt and mix the sheath compound into a molten plastic. A combination of heat and shear forces are used in the process. The molten sheath compound material is then transferred through a series of filters and eventually into a crosshead die. An unwinding station or creel for the incoming monofilament core yarn would be located at such a positon that the monofilament core would feed into the crosshead die. There, the core yarn would then be coated with the sheath compound. The wall thickness of the coated yarn would be controlled by the both die area and also by the speed at which the coated yarn is collected on a spooling device at the exit of the machine. Typically a crosshead die would allow for between 2 and 12 ends of core yarn to be coated at the same time. Each coated end will typically require a specific spooling station or winder. After the coated yarn exists the crosshead, an air space is often used to allow some level of cooling and solidification of the sheath compound prior to the coated yarn entering a cooling trough. The sheath compound will quickly transition from a molten plastic to a solid coating once exposed to the cooling trough, which is generally filled with water. The coated yarn is then spooled on a package.

Other methods may be used to apply the sheath 24 onto the core 22. One such method would be a dipping process, where a plastisol or high viscosity coating compound is used in a trough. The elastic core yarn is then dipped into the trough. The coated yarn is then quickly pulled vertically into an oven where the coating is dried. The individual coated yarns are then spooled on a package.

In other embodiments, the resilient yarn 20 may be formed as a co-extruded bi-component yarn. In this embodiment, the TPE core material is extruded in a continuous process along with the sheath compound. In this example, both the core yarn and sheath are extruded together in one process.

Sample A

A sample resilient yarn ("Sample A") was created using a monofilament 1750 denier core yarn composed of black 72 durometer (Shore D) Hytrel® TPE with a UV stabilization package, available from DuPont™ under the grade name 7246. Inventors coated a sheath onto the core yarn using the extrusion coating method described above. The compound used to form the sheath 24 was UV stabilized and contained a blend of approximately 52% PVC/48% TPU by percentage of resin. The sheath compound used in test Sample A was pigmented with a beige color to represent the ability for the resilient yarn of the present application to perform in colors other than black.

The finished resilient yarns 20 of Sample A ranged in total denier from about 4700-4900 denier, most commonly about 4900. These yarns may also be described by their diameter of about 0.028". However, resilient yarns 20 in the range of about 3000 and about 6000 denier are believed to be suitable for use in fabrics of the present disclosure.

Figure 2A:
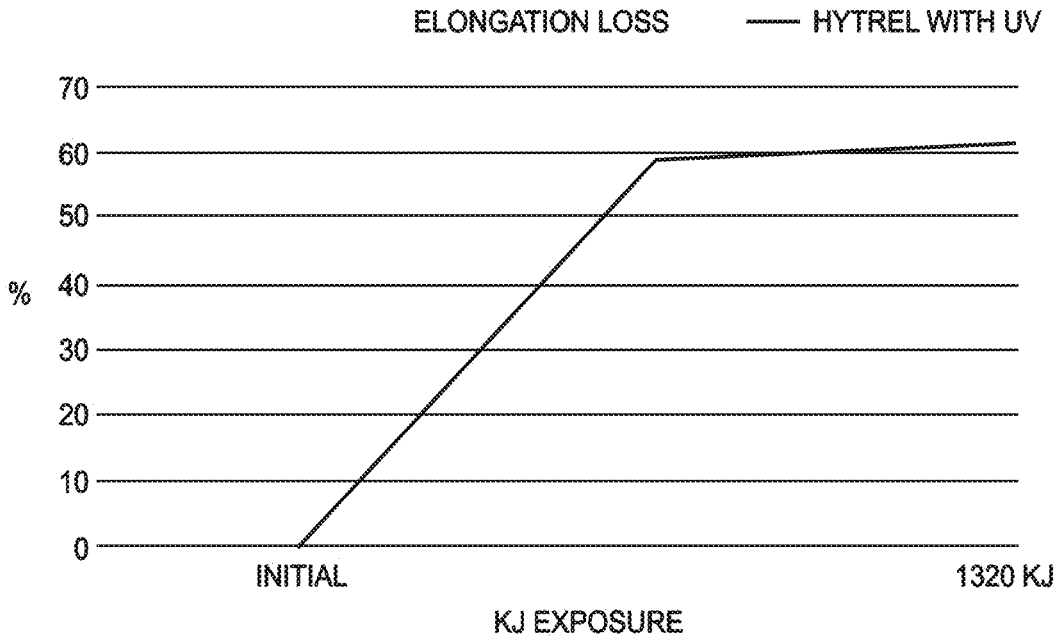
FIGS. 2*a* and 2*b* are graphs of the elongation loss and break strength properties of an uncoated black co-polyester thermoplastic elastomer with a UV stabilization package after being subject to accelerated weather testing according to AATCC 169.
Figure 2B:
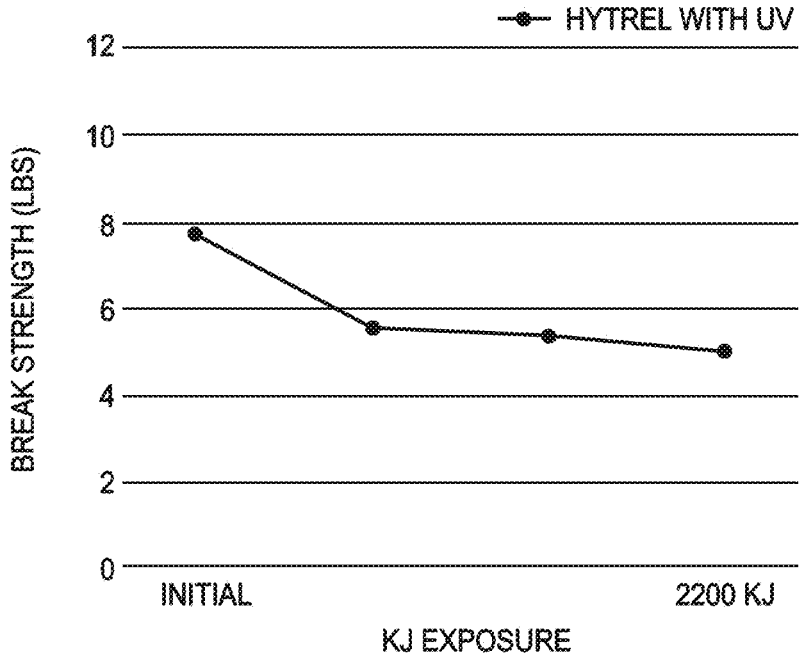
Figure 4:
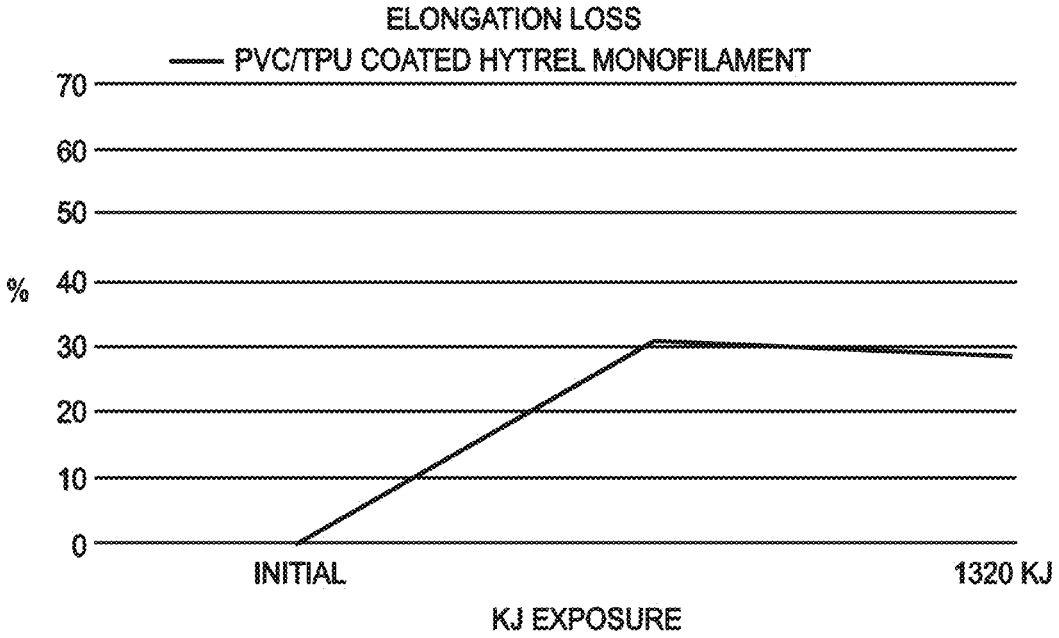
FIG. 4 is a graph of elongation loss experienced by a resilient yarn according to an embodiment of the present disclosure subject to the AATCC 169 weathering test.

FIG. 4 charts the results of accelerated weather testing on the Sample A yarn. Using the AATCC 169 test method (2003), Sample A was tested and the percentage of elongation loss was calculated and charted. As seen in FIG. 4, the elongation loss of Sample A was less than 50% after an exposure of 1320 KJ. The elongation loss of the bare TPE from the elongation chart in FIG. 2A shows that the core yarn alone experienced well over 50% elongation loss.

Figure 5:
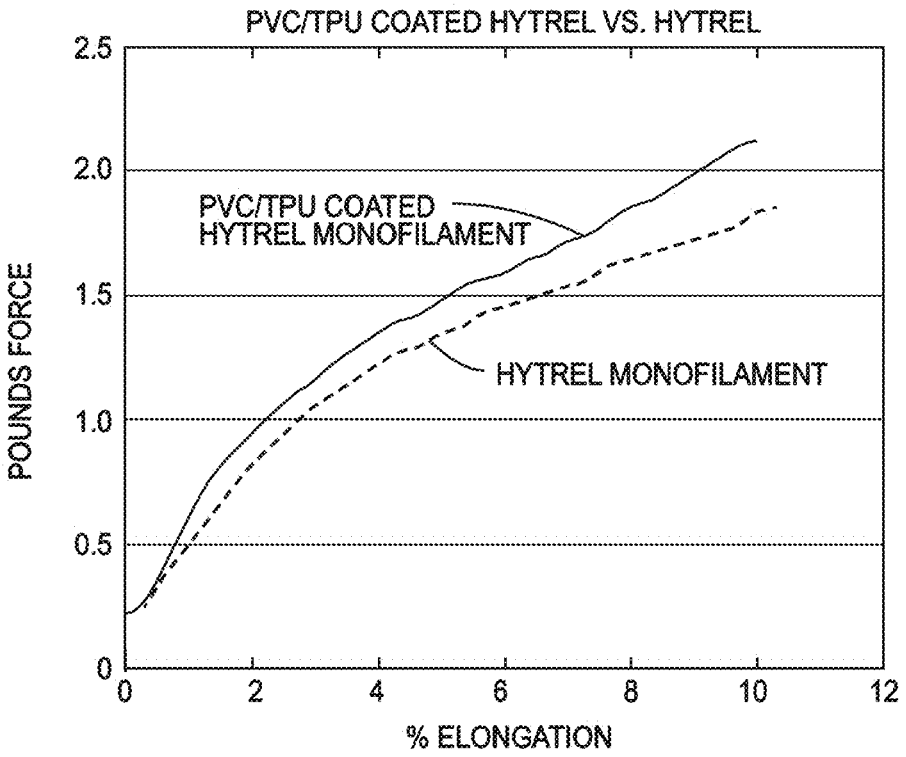
FIGS. 5 and 6 are force versus elongation charts comparing an embodiment of the resilient yarn to a bare core thereof.
Figure 6:
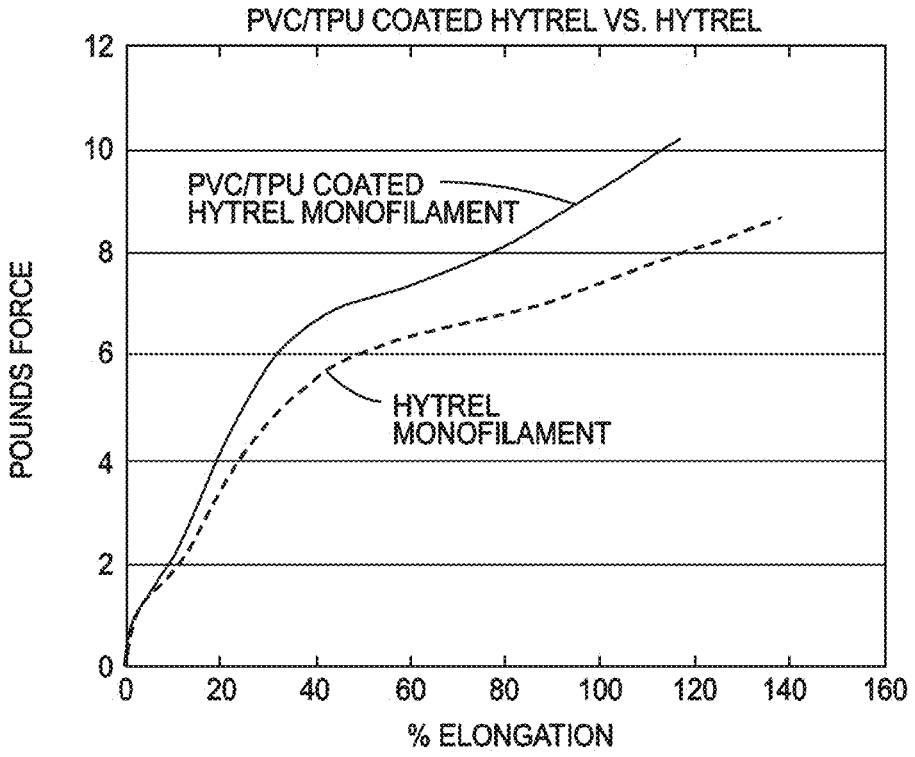

FIGS. 5 and 6 show stress strain curves that compare the performance of the resilient yarn from Sample A compared to the performance of the core alone. As shown, the application of the sheath in Sample A did not significantly impact the elongation characteristics relative to the bare core.

Figure 7:
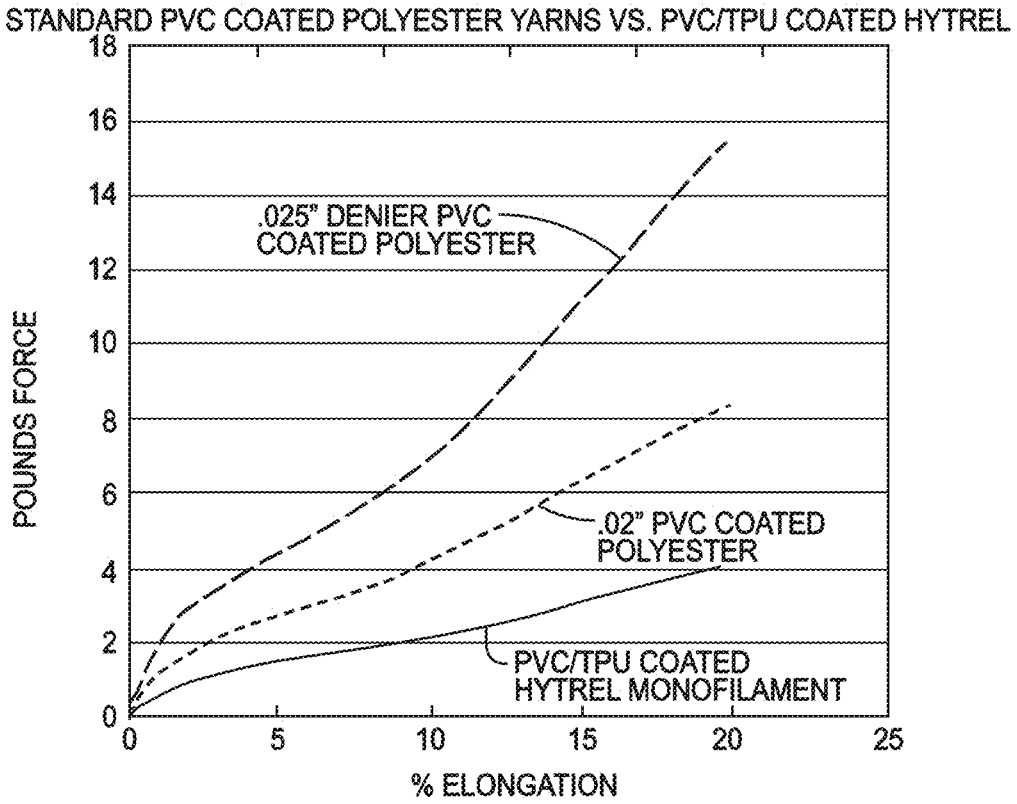
FIG. 7 is a force versus elongation chart comparing an embodiment of the resilient yarn to conventional PVC coated polyester yarns.

FIG. 7 shows a stress-strain curve that compares the elongation characteristics of the Sample A yarn compared to the elongation characteristics of two sizes of PVC coated polyester that are commonly found in outdoor sling fabrics. The two sizes of PVC coated polyester yarn are 2300 denier and 3300 denier. These may also be referred to by their diameters as 0.02 inches and 0.025 inches respectively. As shown, the resilient yarn is able to elongate further under much smaller loads, suggesting a higher-stretch material than the traditional yarns.

Figure 1:
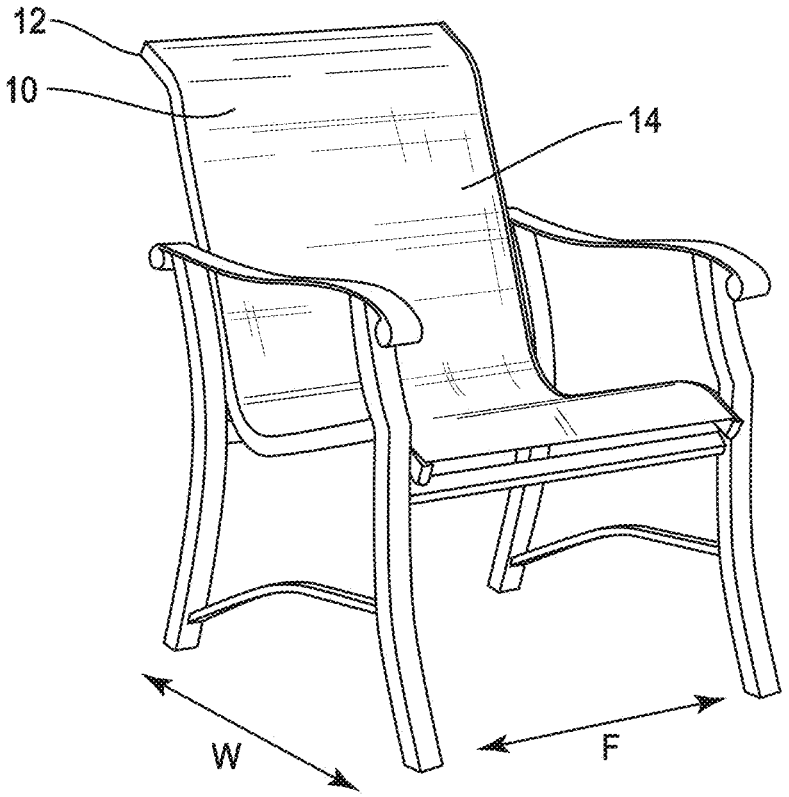
FIG. 1 PRIOR ART
FIG. 1 shows a conventional outdoor sling chair suitable for improvement by the use of the resilient yarns and fabrics described in the present disclosure.
Figure 8:
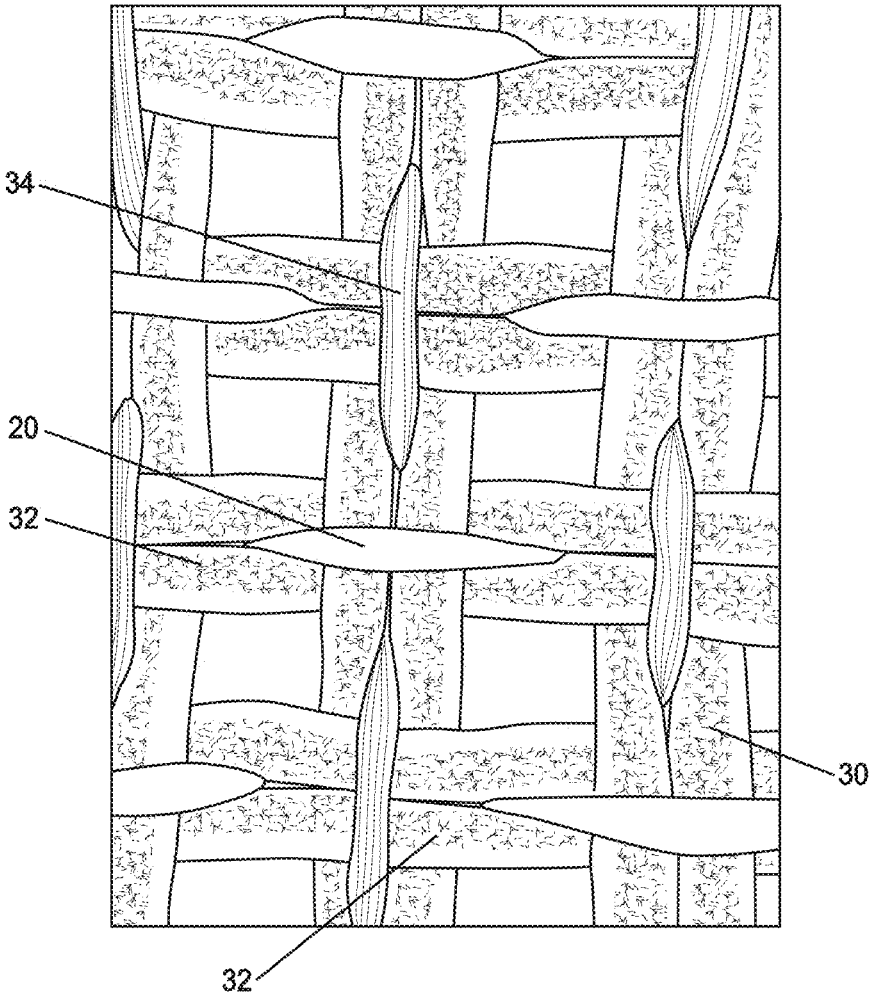
FIG. 8 is a schematic view of a fabric according to an embodiment of the present disclosure.

FIG. 8 shows one schematic example of a fabric 30 that uses the resilient yarn 20. The fabric 30 may be configured for use on sling chairs 10 as shown in FIG. 1. The fabric 30 is not limited to use as a sling panel 14, but may be useful in other outdoor applications with or without being tensioned within a frame, such as umbrellas, awnings, shade sails, hammocks, upholstery, upholstery straps, outdoor sofas, swings, marine covers, etc. The fabric 30 may even be used with indoor applications such as office furniture. In the illustrated embodiment, the fabric 30 is a woven fabric. Knit constructions, such as flat, circular and warp, are also possible.

The illustrated fabric 30 of FIG. 8 includes the resilient yarns 20 of the present disclosure provided in the fill direction. The elasticity of the resilient yarns 20 make them more suitable for weaving into the fabric 30 in the fill direction using modern automated weaving machines. The fill yarns are inserted by modern weaving machines with less dependence upon the elasticity of the yarns. On the other hand, especially in cases where the resilient yarns 20 are inserted with other yarns, the high level of uniform force tensioning the warp yarns could result in inconsistency within the finished fabric 30 if the resilient yarns were provided in the warp direction. In some applications, however, the resilient yarns 20 could be in the warp direction.

The fabric 30 may also include spun yarn 32 in each of the warp and fill directions. In other embodiments, spun yarns 32 may be included in only one of the warp and fill directions. In yet other embodiments, no spun yarns 32 may be provided. In one embodiment, the spun yarn 32 comprise spun solution dyed acrylic yarns. These may be formed by either open end or ring spinning processes as are known in the art. As is known in the art, ring spinning generally produces yarns that are stronger than open end spinning. Solution dyed spun acrylic yarns may be highly suitable for use as the spun yarns 32 because they have been shown to have industry leading colorfastness and durability after prolonged UV exposure, while also providing a well-regarded hand suitable for indoor furniture. Other examples of spun yarns 32 that could be suitable for an outdoor fabric include spun yarns made from polyester, polyethylene, or polyolefin.

In addition to, or in place of, the spun yarns 32, multifilament yarns made from acrylic, polyester, polyethylene, or polyolefin may be included in the fabric 30. The spun yarns 32 and the multifilament yarns may be dope dyed. It is also reasonable that woven or knitted fabrics according to the present disclosure could also include other monofilament or polymer coated yarns. An example of other polymer coated yarn could include an over coating of thermoplastic olefin over a polyethylene, polyester or polyolefin core yarn. This core could be monofilament or multifilament in design.

Lastly, strength yarns 34, such as PVC coated polyester yarns may also be provided in the warp direction. The strength yarns 34 provide tenacity to strengthen the fabric 30. Strength yarns 34 may also include polyester, fiberglass, or olefin yarns that are coated with a low melt layer to facilitate heat setting. The strength yarns 34 may be provided, additionally or alternatively, in the fill direction, or may be omitted entirely.

In one embodiment, the fabric 30 is subject to a finishing process that results in thermal bonding the strength yarns 34 to the sheath 24 of the resilient yarns. As a result, the resilient yarns 20 are tacked to the strength yarns 34 where they cross and contact one other. The resulting grid of tacked locations controls the degree of stretch for the fabric 30 and adds strength to the fabric 30 as well. Further, the tacking also controls and holds the resilient yarns. The elastic yarn in many fabrics is free to float within the weave, leading to inconsistent performance. This is not the case when the resilient yarns 20 of the present disclosure are thermally bonded to other yarns within the fabric 30. The resulting fabric 30 is expected to provide a desirable appearance, hand and comfort performance because of the combination of the resilient yarns 20 used for stretch, the spun yarns 32 used for hand, and the strength yarns 34 used for strength and thermal bonding.

In the illustrated example of FIG. 8, the resilient yarns 20 are provided in the fill direction of the fabric 30. By providing the resilient yarns 20 in the fill direction, as opposed to the warp direction, modern high-speed weaving machines are able to produce a more consistent fabric 30. Fabric 30 may be manufactured with conventional machines such that the fabric has a useable width of approximately 54 inches. A chair fabricator may then cut two sling panels 14 side-by-side out of the width. When using the fabric 30 in a sling chair 10, the fill direction often corresponds with the widthwise direction of the chair. The fill direction is shown in FIG. 1 by the arrow labeled F. The warp direction is shown in FIG. 1 by the arrow labeled W. Additionally, one skilled in the art would appreciate that the fabric 30 could be used in other frames 12 and applications where the warp direction W could become the width of the chair 10. In one embodiment, the chair 10 may have a first sling panel associated with the seat portion and a second separate sling panel associated with the back portion. A fabricator may use different fabrics on each sling panel to customize the seating experience. A fabricator may pre-tension the sling panels by different amounts to customize the seating experience.

Specific examples of fabric constructions are discussed in the examples below:

Example 1

Figure 9:
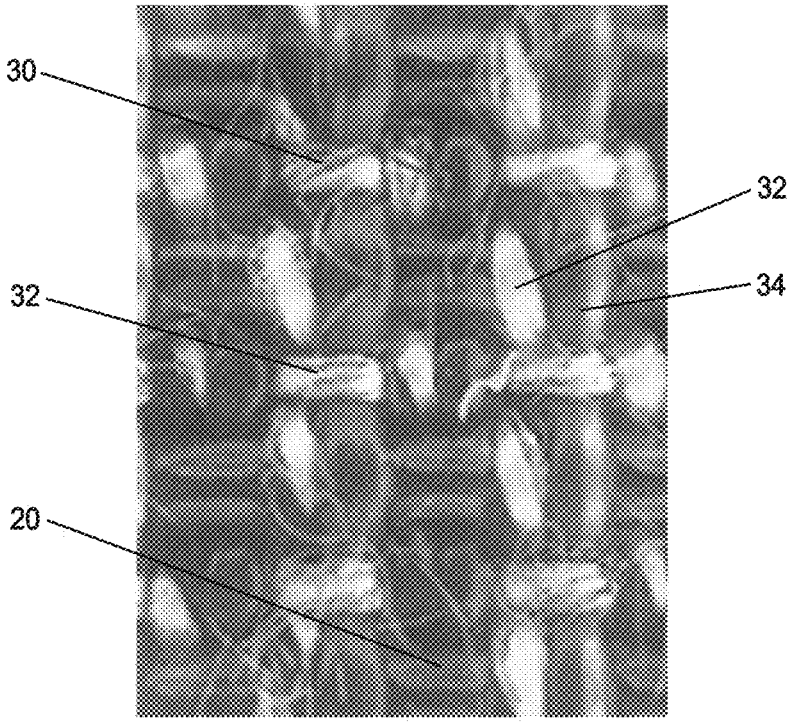
FIG. 9 is an image of a first example fabric.

The face of a fabric according to Example 1 is shown in FIG. 9. The woven fabric of Example 1 has an end and end construction with 0.020" PVC coated polyester and 18/2 cc ring spun acrylic yarn in the warp direction. The fill (weft) direction has a pick and pick construction where every other pick weaves in either 18/2 cc ring spun acrylic yarn or the resilient yarn according to Sample A. The fabric according to Example 1 is then heat set to thermally bond the PVC coated polyester ends to the resilient yarns at locations where they contact as they cross.

Figure 10:
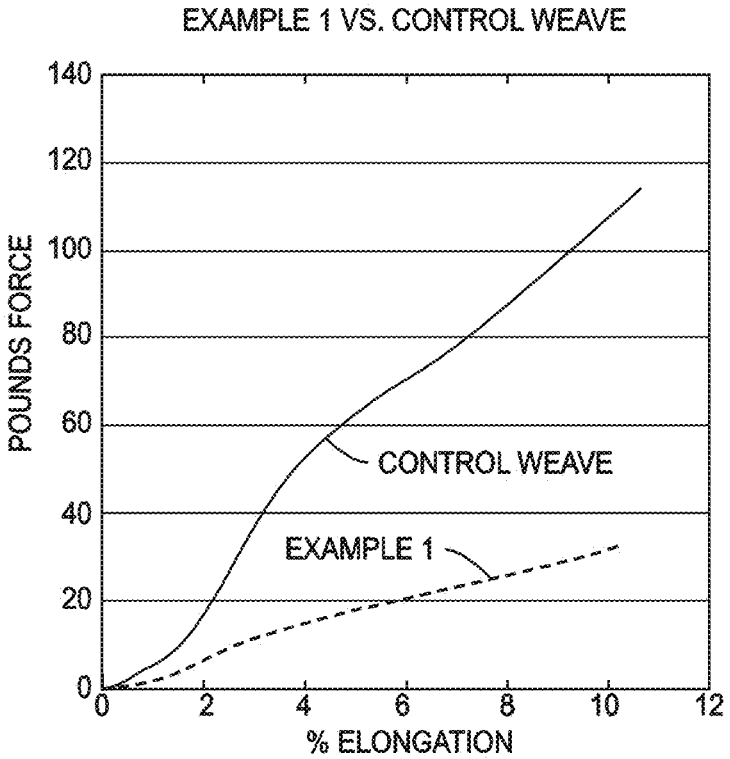
FIG. 10 is a force versus elongation chart comparing the first example fabric to a first comparative fabric.

FIG. 10 shows a stress stain curve comparing the fabric of Example 1 to a comparative sample of the same weave where the resilient yarn of Sample A is replaced by 0.020" PVC coated polyester. As seen, the fabric of Example 1 takes less force to elongate compared to the comparative fabric. Greater elongation under less force results in a more responsive fabric, which in applications such as sling chairs, results in a more comfortable seating experience.

Example 2

Figure 11:
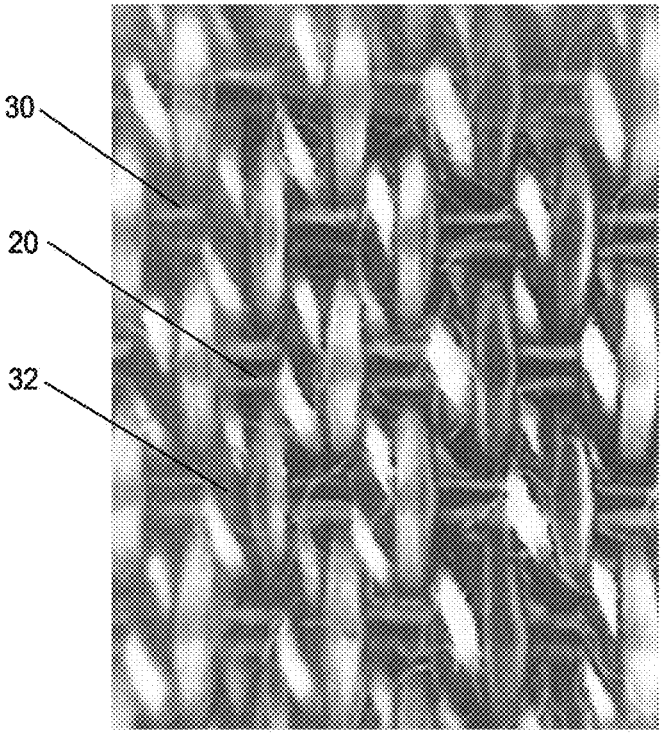
FIG. 11 is an image of a second example fabric.
Figure 12:
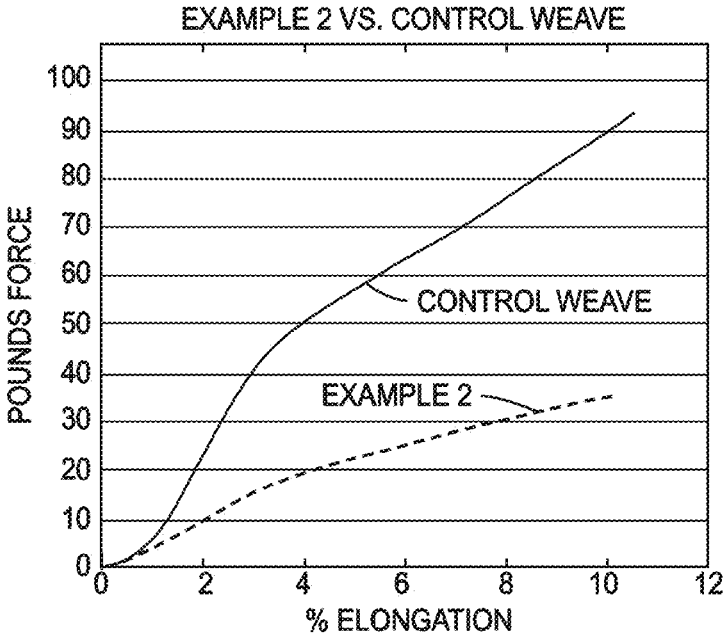
FIG. 12 is a force versus elongation chart comparing the second example fabric to a second comparative fabric.

The face of a fabric according to Example 2 is shown in FIG. 11. The fabric of Example 2 is constructed similar to Example 1, but 100% of the fill direction yarns comprise resilient yarns according to Sample A. The finished construction of Example 2 has 43 ends per inch in the warp direction and 13 picks per inch in the weft direction. FIG. 12 shows a stress stain curve comparing the fabric of Example 2 to a comparative sample of the same weave with the resilient yarn replaced by 0.025" PVC coated polyester.

Example 3

Figure 13:
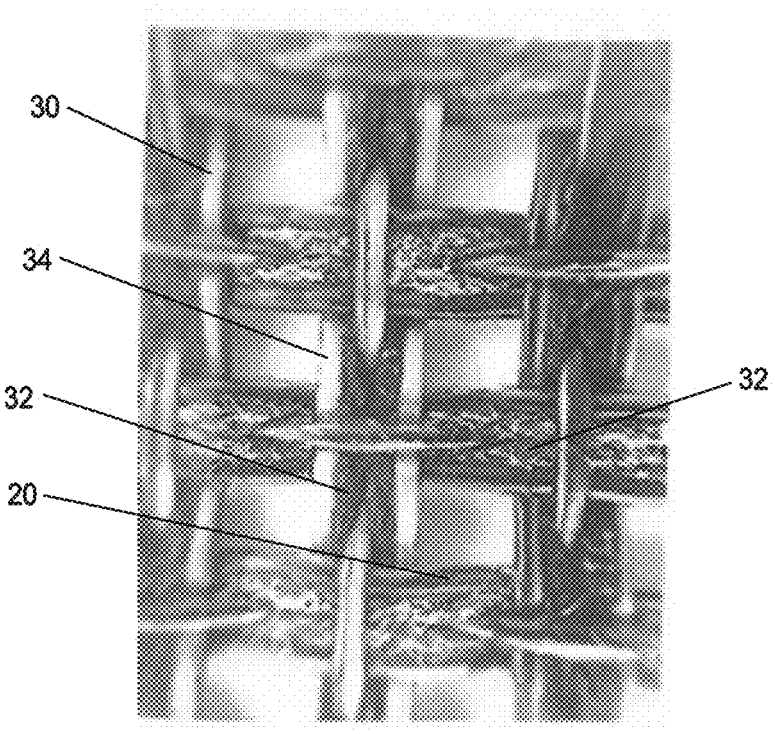
FIG. 13 is an image of a third example fabric.
Figure 14:
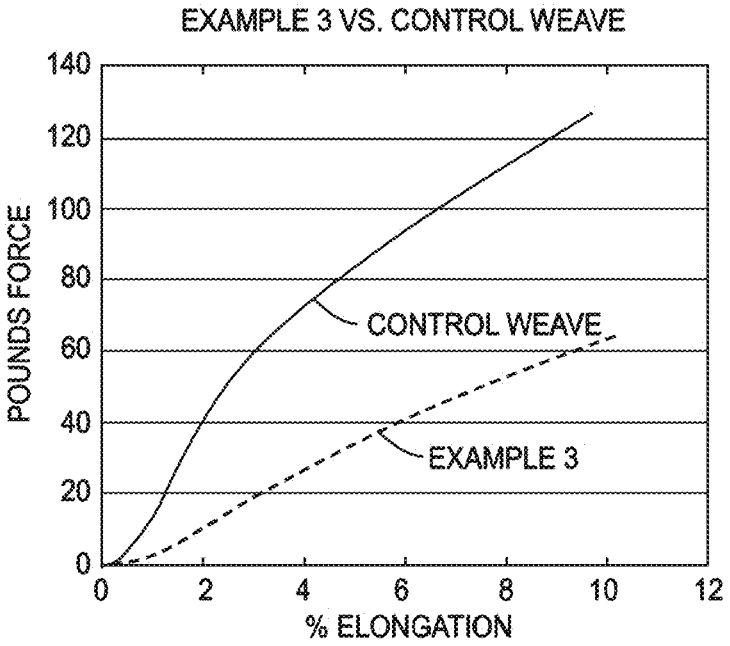
FIG. 14 is a force versus elongation chart comparing the third example fabric to a third comparative fabric.

The face of a fabric according to Example 3 is shown in FIG. 13. Example 3 has a warp construction comprising an end and end arrangement of 0.025" PVC coated polyester and 8.75/2 cc open end spun acrylic. The weft construction comprises a pick and pick arrangement of resilient yarn according to Sample A and 8.75/2 cc open end spun acrylic. The finished construction of Example 3 has 25 ends per inch in the warp direction and 25 picks per inch in the weft direction. FIG. 14 shows a stress stain curve comparing the fabric of Example 3 to a comparative sample of the same weave with the resilient yarn replaced by 0.025" PVC coated polyester.

Example 4

Figure 15:
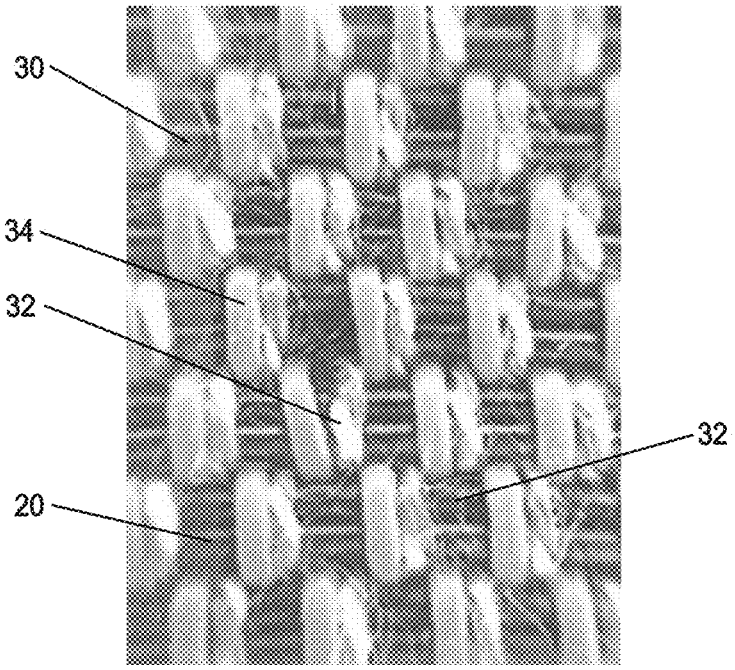
FIG. 15 is an image of a fourth example fabric.

The face of a fabric according to Example 4 is shown in FIG. 15. Example 4 has a warp construction comprising an end and end arrangement of 0.020" PVC coated polyester and 18/2 cc ring spun acrylic. Example 4 has a weft construction having a pick and pick arrangement of 0.028" resilient yarns according to Sample A and 4/2 cc ring spun acrylic. The finished construction of Example 4 has 42 ends per inch in the warp and 24 picks per inch in the weft direction.

Example 5

Figure 16:
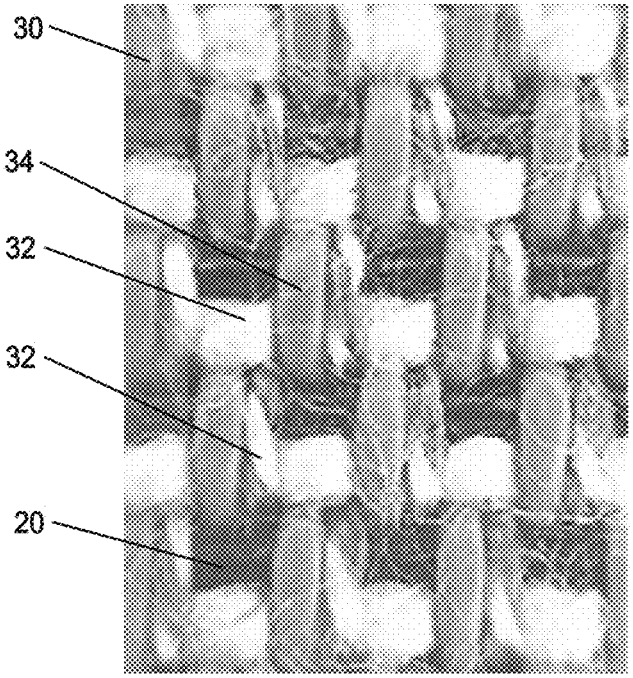
FIG. 16 is an image of a fifth example fabric.
Figure 17:
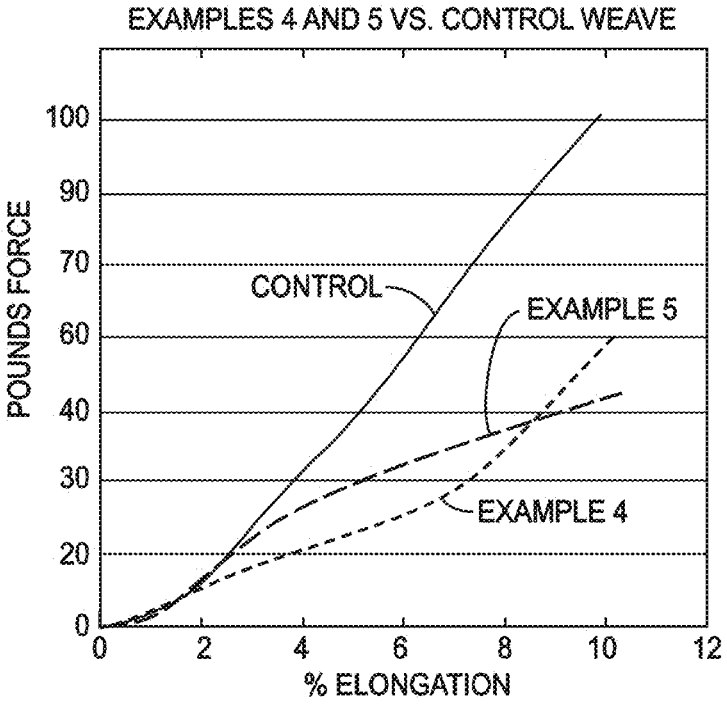
FIG. 17 is a force versus elongation chart comparing the fourth and fifth example fabrics to a fourth comparative fabric.

The face of a fabric according to Example 5 is shown in FIG. 16. The weave of Example 5 is the same as Example 4 but the weft construction comprises 100% resilient yarns according to Sample A. FIG. 17 shows a stress stain curve comparing the fabrics of Examples 4 and 5 to a comparative sample of the same weave with the resilient yarn replaced by 0.025" PVC coated polyester.

Example 6

Figure 18:
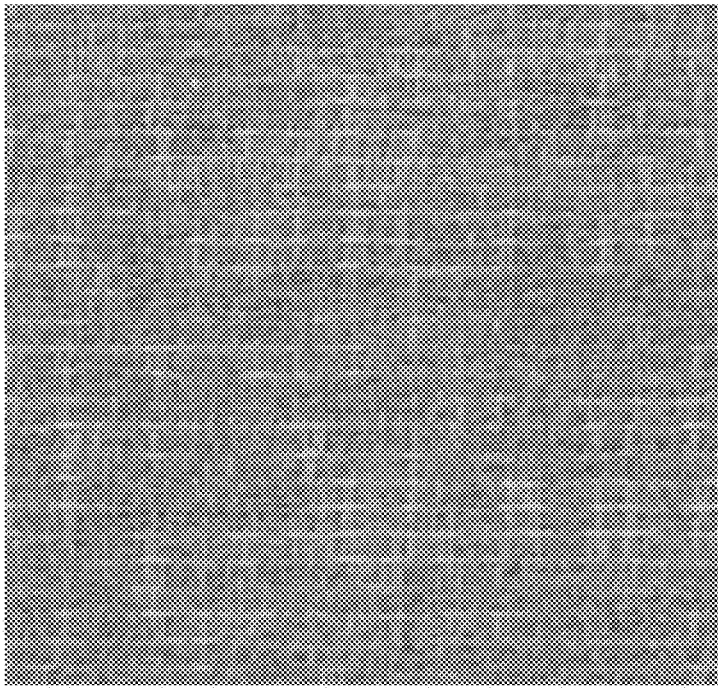
FIG. 18 is an image of a sixth example fabric.

The face of a fabric according to Example 6 is shown in FIG. 18. Example 6 has a warp construction comprising an end and end arrangement of 0.020" PVC coated polyester and 18/2 cc ring spun acrylic. Example 6 has a weft construction having one pick with resilient yarns according to Sample A to every three picks weaving in 8.75/2 cc open end spun acrylic.

Example 7

Figure 19:
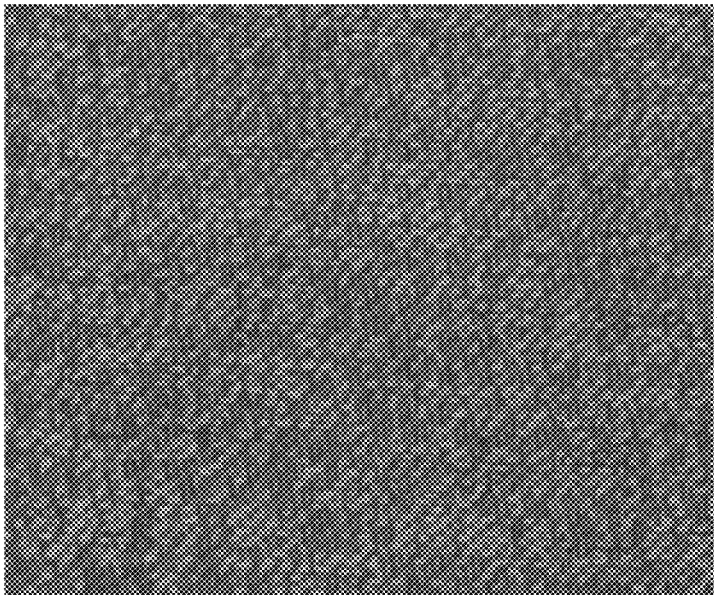
FIG. 19 is an image of a seventh example fabric.

The face of a fabric according to Example 7 is shown in FIG. 19. Example 7 has a warp construction comprising an end and end arrangement of 0.020" PVC coated polyester and 18/2 cc ring spun acrylic. Example 7 has a weft construction having one pick with resilient yarns according to Sample A to every three picks with 8.75/2 cc open end spun acrylic.

Example 8

Figure 20:
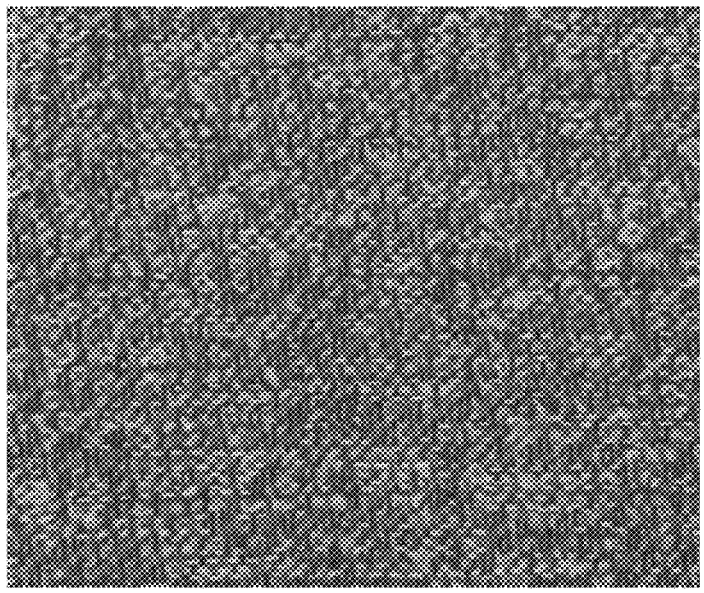
FIG. 20 is an image of an eighth example fabric.

The face of a fabric according to Example 8 is shown in FIG. 20. Example 8 has a warp construction comprising an end and end arrangement of 0.02" PVC coated polyester and 18/2 cc ring spun acrylic. Example 8 has a weft construction having a four-pick arrangement of: one pick having resilient yarns according to Sample A; one pick having 18/2 cc ring spun acrylic; one pick having 1800 yards per pound acrylic Chenille yarn and the last pick having 18/2 cc ring spun acrylic.

Example 9

Figure 21:
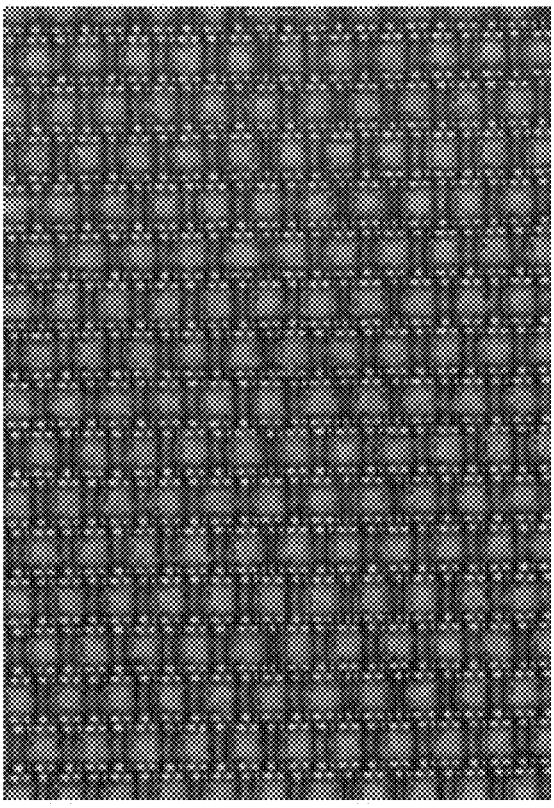
FIG. 21 is an image of a ninth example fabric.

The face of a fabric according to Example 9 is shown in FIG. 21. Example 9 has a warp construction comprising an end and end arrangement of 0.02" PVC coated polyester and 18/2 cc ring spun acrylic. Example 9 has a weft construction having a seven-pick repeating arrangement of: a first pick with 18/2 cc ring spun acrylic; a second pick with 1800 yards per pound chenille acrylic; a third pick with resilient yarns according to Sample A; a fourth pick with 1800 yards per pound chenille acrylic; a fifth pick with 18/2 cc ring spun acrylic; and sixth and seventh picks with resilient yarns according to Sample A one pick having 18/2 cc ring spun acrylic; one pick having 1900 yards per pound acrylic novelty yarn and the last pick having 18/2 cc ring spun acrylic.

Example 10

Figure 22:
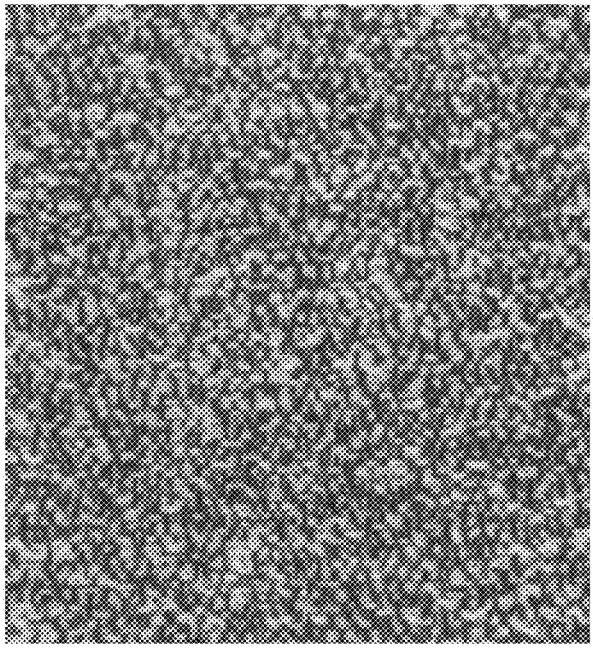
FIG. 22 is an image of a tenth example fabric.

The face of a fabric according to Example 10 is shown in FIG. 22. Example 10 has a warp construction comprising an end and end arrangement 0.02" PVC coated polyester and 18/2 cc ring spun acrylic. Example 10 has a weft construction having a pick and pick repeating arrangement of: resilient yarns according to Sample A and a chenille acrylic yarn of about 1900 yards per pound.

Example 11

Figure 23:
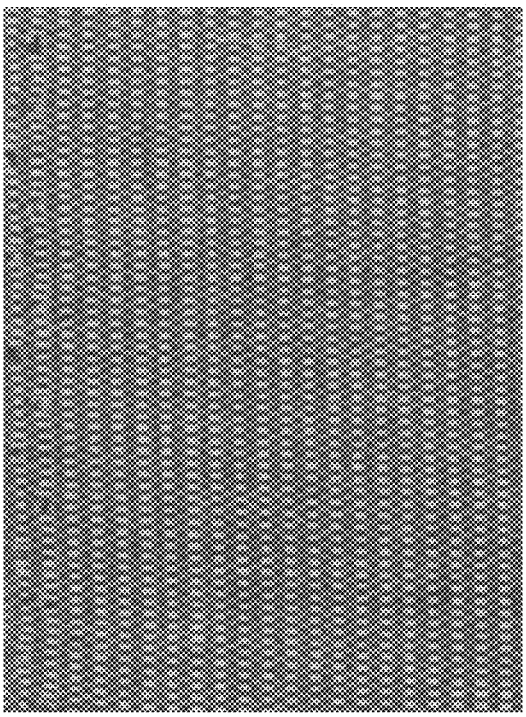
FIG. 23 is an image of an eleventh example fabric.

The face of a fabric according to Example 11 is shown in FIG. 23. Example 11 has a warp construction comprising an end and end arrangement of 0.02" PVC coated polyester and 18/2 cc ring spun acrylic. Example 11 has a weft construction having a pick and pick repeating arrangement of: resilient yarns according to Sample A and 8.75/2 cc open end spun acrylic yarns.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A method comprising:

weaving an outdoor fabric, the outdoor fabric comprising:

resilient yarns in a fill direction, the resilient yarns comprising:

a core comprising at least a thermoplastic co-polyester elastomer, and a sheath comprising at least polyvinyl chloride such that the polyvinyl chloride completely surrounds the core; and other yarns in a warp direction, at least some of the other yarns comprising strength yarns; and heat setting the fabric to tack the sheath of the resilient yarns to at least some of the other yarns.

2. The method of claim 1 further comprising a step of forming the resilient yarn, the step of forming the resilient yarn comprises:

acquiring a monofilament to form the core;

melting a sheath compound in an extrusion screw;

feeding the molten sheath compound to a crosshead die;

feeding the monofilament to the crosshead die;

coating the monofilament with a layer of the molten sheath compound; and cooling the sheath compound, the sheath compound forming the sheath.

3. A woven outdoor fabric, comprising:

a plurality of fill yarns comprising resilient yarns, the resilient yarns comprising:

a core comprising at least a thermoplastic co-polyester elastomer, and a sheath comprising at least polyvinyl chloride such that the polyvinyl chloride completely surrounds the core; and a plurality of warp yarns, and wherein the sheath of the plurality of resilient yarns is thermally bonded to at least some of the plurality of warp yarns.

4. The fabric of claim 3, wherein the plurality of resilient yarns experience an elongation loss of less than 50% after being subject to 1320 KJ in accordance with the AATCC 169 (2003) test method such that the fabric is suitable for outdoor use.

5. The fabric of claim 3, wherein the sheath further comprises polyurethane.

6. The fabric of claim 3, wherein the sheath further comprises at least one of color pigment, UV stabilizers, antifungal agents, heat stabilizers, lubricants, and flame retardants.

7. The fabric of claim 3, wherein the thermoplastic co-polyester elastomer has a durometer of between about 50 and about 75 in the shore D scale.

8. The fabric of claim 3, wherein the resilient yarns each have a total denier between about 3000 and about 6000.

9. The fabric of claim 3, wherein the core has a denier of between about 1200 and about 2500.

10. The fabric of claim 3, wherein the sheath has a thickness of about 0.0025" to about 0.05".

11. A woven outdoor fabric, comprising:

a plurality of fill yarns comprising resilient yarns, the resilient yarns comprising:

a core comprising at least a thermoplastic co-polyester elastomer, and a sheath completely surrounding the core and comprising a blend of at least polyvinyl chloride and polyurethane; and a plurality of warp yarns, and wherein the sheath of the plurality of resilient yarns is thermally bonded to at least some of the plurality of warp yarns.

12. The fabric of claim 11, wherein the plurality of resilient yarns experience an elongation loss of less than 50% after being subject to 1320 KJ in accordance with the AATCC 169 (2003) test method such that the fabric is suitable for outdoor use.

13. The fabric of claim 11, wherein the sheath further comprises at least one of color pigment, UV stabilizers, antifungal agents, heat stabilizers, lubricants, and flame retardants.

14. The fabric of claim 11, wherein the thermoplastic co-polyester elastomer has a durometer of between about 50 and about 75 in the shore D scale.

15. The fabric of claim 11, wherein the resilient yarns each have a total denier between about 3000 and about 6000.

16. The fabric of claim 11, wherein the core has a denier of between about 1200 and about 2500.

17. The fabric of claim 11, wherein the sheath has a thickness of about 0.0025" to about 0.05".

18. The method of claim 1 further comprising forming the resilient yarn by coating an entire outer surface of the core to form a sheath about the outer surface of the core, the sheath including a blend of the at least polyvinyl chloride and polyurethane.

* * * * *